US005815774A

United States Patent [19]

Funayama et al.

[11] Patent Number: 5,815,774

[45] Date of Patent: Sep. 29, 1998

[54] IMAGE RECORDING APPARATUS WITH PHOTOSENSITIVE UNIT HAVING POROUS INSULATING SCREEN

[75] Inventors: Yasuhiro Funayama; Tsutomu Uezono, both of Tokyo, Japan

[73] Assignee: NEC Corporation, Tokyo, Japan

[21] Appl. No.: 788,299

[22] Filed: Jan. 24, 1997

[30] Foreign Application Priority Data

Jan. 26, 1996 [JP] Japan ..... 8-011804

[51] Int. Cl.[6] ..... G03G 15/24

[52] U.S. Cl. ..... 399/159; 347/55; 399/266; 399/291

[58] Field of Search ..... 347/55, 141; 399/289, 399/290, 291, 55, 222, 252, 159, 152, 153, 154, 266; 430/126, 136, 55

[56] References Cited

U.S. PATENT DOCUMENTS

| | | | |
|---|---|---|---|
| 2,758,524 | 8/1956 | Sugarman et al. | 430/102 |
| 3,502,408 | 3/1970 | Brodie | 399/136 |
| 3,772,010 | 11/1973 | Weiss | 399/159 X |
| 3,776,630 | 12/1973 | Ohno et al. | 430/126 X |
| 5,159,389 | 10/1992 | Minami et al. | 399/159 |
| 5,477,250 | 12/1995 | Larson | 347/55 |
| 5,532,796 | 7/1996 | Narikawa et al. | 399/152 |
| 5,537,199 | 7/1996 | Takai et al. | 399/159 X |
| 5,585,893 | 12/1996 | Fujita et al. | 399/159 |

FOREIGN PATENT DOCUMENTS

| | | |
|---|---|---|
| 61-260283 | 11/1986 | Japan . |
| 61-286164 | 12/1986 | Japan . |

*Primary Examiner*—Arthur T. Grimley
*Assistant Examiner*—Sophia S. Chen
*Attorney, Agent, or Firm*—Foley & Lardner

[57] ABSTRACT

An image recording apparatus with a photosensitive unit 100A which is rotatably structured, having a transparent conductive layer 2, a photoconductive layer 3, and a porous insulating screen 4 with an electrode layer 5 on its top surface which are sequentially stacked on a transparent substrate. An electric field is applied between the transparent conductive layer 2 and the electrode layer 5. Therefore, when a light is irradiated to the photoconductive layer 3 via the transparent layer 2, a photoconductive phenomenon takes place. The electrode layer 5 has a potential so that the conductive particles returns to an electrode member 11. The electrode member 11 for holding conductive color particles on its surface is opposite to the photosensitive unit 100A with a gap between. The conductive particles filled between the porous insulating screen 4 are transferred to a record medium.

16 Claims, 8 Drawing Sheets

IMAGE RECORDING APPARATUS WITH PHOTOSENSITIVE UNIT HAVING POROUS INSULATING SCREEN

BACKGROUND OF THE INVENTION

1. Field of the Invention

The present invention relates to an image recording apparatus in use for a copying machine, a printer, or a facsimile, and more particularly to an image recording apparatus for recording images by using a photosensitive unit having a porous insulating screen.

2. Description of the Prior Arts

As a conventional image forming technique for a copying machine or a printer, there is an electrophotographic process, which is applied to a wide range of uses. There is a Carlson process (xerography) as this type of a typical process. This method requires six processes such as charging, exposing, developing, transferring, fixing, and cleaning.

As a simplified electrophotographic process alternative to the Carlson process, there is disclosed an electrophotographic process which does not require charging of a photoreceptor, but performs exposing, developing, and transferring at a time in U.S. Pat. No. 2,758,524 (issued in 1956), Japanese Non-examined Patent Publication No. 61-260283 (issued Nov. 18, 1986), and Japanese Non-examined Patent Publication No. 61-286164 (issued Dec. 16, 1986).

First, a description will be given below for an electrophotographic process disclosed in the U.S. Pat. No. 2,758,524.

A non-charged conductive color particle layer is formed on a photoreceptor. The photoreceptor comprises a transparent substrate, a transparent conductive layer, and a photoconductive layer. An image exposure is performed from a side of the transparent substrate to reduces an electrical resistance of the photoconductive layer, and electric charges are injected from the photoconductive layer to conductive particles only in an exposed portion. Then, only conductive color particles charged by the charge injection jump to a side of record paper and an opposing electrode spaced from the photoreceptor with a gap due to an effect of an electric field.

The electric field formed in the photoreceptor and in the gap, which is obtained by applying a DC voltage to a portion between the opposing electrode at the back of the paper and the transparent conductive layer, is considered to be approx. 3 kV/cm.

In this case, however, there is a problem that it takes a long time for moving charges due to an insufficiency of the electric field so as to dissociate hole electron pairs generated by an optical energy in the photoconductive layer and to move charge carriers. It is said that moving charges instantaneously in the photoreceptor generally requires an electric field of $10^5$ V/cm or greater. Therefore, to form a high electric field like this between the transparent conductive layer and the opposing electrode such as those used in the above U.S. Pat. No. 2,758,524, there is a problem that the electric field reaches an air breakdown field impractically.

Next, the electrophotographic process disclosed in the Japanese Non-examined Patent Publication No. 61-260283 is described with a reference to FIG. 9.

A toner layer of charged toner 850 is formed on a photoconductive layer 803 which is the same as for the electrophotographic process disclosed in the U.S. Pat. No. 2,758,524. This process differs from one disclosed in the U.S. Pat. No. 2,758,524 in that the charged toner 850 is previously positive-charged in an electrode plate 851 to which a voltage is applied. An electric field is formed in the photoconductive layer 803 by the charged toner 850. At this point, an image exposure from the side of the transparent substrate 801 reduces an electric resistance of the photoconductive layer 803, so that charges of the charged toner 850 leak to the side of a transparent conductive layer 802, or charges having an opposite polarity are injected from the photoconductive layer 803 to the toner 850, so that the toner 850 becomes negative-charged and then moves to a record medium 808 which is positive-charged so as to record an image.

Also in the above process, the charged toner 850 must be conductive so as to negative-charge the charged toner 850 instantaneously in the same manner as for the process disclosed in the U.S. Pat. No. 2,758,524. It, however, means that the charged toner 850 which is always in contact with the electrode plate 851 conducts to the electrode plate 851. Consequently, charges are injected from portions other than the photoconductive layer 803 to the charged toner 850 when the positive-charged record medium 808 is placed in the upper side of the charged toner 850 so as to allow the charged toner 850 to jump to the record medium 808. Accordingly, this method has a problem that it is impossible to attach the charged toner 850 to paper selectively to form an image.

As a method of resolving the problem that charges are injected from the portions other than the photoconductive layer to the charged toner 850, there is an electrophotographic process disclosed in the Japanese Non-examined Patent Publication No. 61-286164. In the process disclosed in this patent, a first method to prevent charges from being injected to the toner is to provide a floating electrode on a photoconductive layer so as to reduce a time for injecting the charges to the toner by lowering a value of resistance between the toner and the photoconductive layer. In this case, since conductive toner must be used, it is impossible to prevent charges from leaking horizontally. Therefore, as described with an example shown in FIG. 9, the toner 850 cannot selectively jump to the record medium 808 so as to attach to it, either.

A second method of preventing charges from being injected to the toner in the process disclosed in the above patent is to provide lattice partitions of an insulating material on a photoconductive layer so as to prevent charges between dots from leaking horizontally. An electrode, which also serves as a regulating blade and to which a high voltage is applied, supplies conductive color particles to the lattice partitions. The conductive color particles are supplied to each recess portion within the lattice partitions by moving the electrode on the lattice partitions, and further charges are injected to the particles from the electrode so as to generate an electric field in a photosensitive layer.

The charged amount, however, is limited since a repulsion between charged particles must be inhibited. As a result, there is a problem that an electric field formed by the charged particles in the photosensitive layer is extremely weak and therefore it takes a long time for moving charges impractically.

In the electrophotographic process disclosed in the U.S. Pat. No. 2,758,524 of the above conventional examples, there is a problem that it is impractical since it takes a long time for moving charges due to an insufficiency of an electric field.

In both of the electrophotographic process disclosed in the Japanese Non-examined Patent Publication No. 61-260283 and the first method of the electrophotographic process disclosed in the Japanese Non-examined Patent Publication No. 61-286164, there is a problem that it is impossible to attach charged toner to paper selectively to form an image.

In the second method of the electrophotographic process disclosed in the Japanese Non-examined Patent Publication No. 61-286164, there is a problem that an electric field formed by charged particles in the photosensitive layer is extremely weak and therefore it takes a long time for moving charges impractically.

SUMMARY OF THE INVENTION

The present invention is provided from the above viewpoints on the problems of the conventional techniques and it is an object of the present invention to provide an image recording apparatus which can easily form an electric field of $10^5$ V/cm or greater in a photoconductive layer so as to allow conductive toner on the photoconductive layer jump to a record medium with only an exposed portion selectively arranged with a gap between.

It is another object of the present invention to provide an image recording apparatus which can prevent charges between conductive color particles from leaking horizontally so as to obtain a high image quality stably and prevent an occurrence of fogging and its method.

The image recording apparatus of the present invention comprises a photosensitive unit which rotates and is composed of a transparent substrate, a transparent conductive layer, a photoconductive layer, and a porous insulating screen with an electrode layer on its top surface which are stacked sequentially from the bottom. A particle supplying device supplies conductive color particles charged to a given polarity to a plurality of minute holes formed in the porous insulating screen. A predetermined electric potential is applied to the electric layer on the top surface of the insulating screen so that the electric layer returns the conductive color particles supplied from the particle supplying device. An electric field applying device applies an electric field between the transparent conductive layer and the electrode layer on the top surface of the insulating screen to cause a photoconductive phenomenon. An exposing device and a transferring device are further included in the image recording apparatus of the invention.

The exposing device generates a photoconductive phenomenon by putting a light selectively on the photoconductive layer of the photosensitive unit after supplying the conductive color particles charged by the particle supplying device. It changes the charges on the conductive color particles existing in a portion which the light has been put on. This change is necessary for transferring.

The transferring device, which is arranged opposite to the photosensitive unit, transfers the conductive color particles in the minute holes at the exposed position to a record medium by means of the electric field.

According to the present invention, since an electric field is applied between the transparent conductive layer and the electrode layer on the top surface of the porous insulating screen, an electric field of $10^5$ V/cm or greater can be easily established. Moreover, since a predetermined electric potential is applied to the electric layer on the top surface of the insulating screen, the electric layer returns the conductive color particles supplied from the particle supplying device and high image quality is achieved stably.

The electric field applying device includes an adjusting circuit for adjusting an amount of the charged conductive color particles put in the minute holes in the insulating screen by means of the voltage applied to the portion between the transparent conductive layer and the electrode layer on the top surface of the insulating screen. This makes it possible to change a record density.

The particle supplying device as an embodiment includes an electrode member holding conductive color particles on its surface and opposing to the photosensitive unit with a gap between and a circuit for applying a voltage to the electrode member so as to generate an electric field between the electrode member and the transparent conductive layer. Conductive color particles charged according to the voltage are supplied by moving from the electrode member to a plurality of minute holes.

In this case, assuming that V1 is a first voltage applied to the transparent conductive layer, V2 is a second voltage applied to the electrode layer on the top surface of the insulating screen, and V3 is a third voltage applied to the electrode member of the particle supplying device, V1>V2>V3 is satisfied for a negative charging polarity of the conductive color particles from the particle supplying device, and V1<V2<V3 is satisfied for a positive charging polarity thereof.

For example, if the charging polarity of the conductive color particles is negative, the conductive color particles charged to the negative polarity by induction charging jump toward the transparent conductive layer of the photosensitive unit so that the minute holes in the insulating screen are filled with the particles. At this point, conductive color particles which have impinged upon the electrode layer on the top surface of the insulating screen bound back with opposite polarity of charges to return to the electrode member of the particle supplying device.

DETAILED DESCRIPTION OF THE PREFERRED EMBODIMENTS

Before describing embodiments of the present invention, its principle will be explained below, first.

Figure 1:
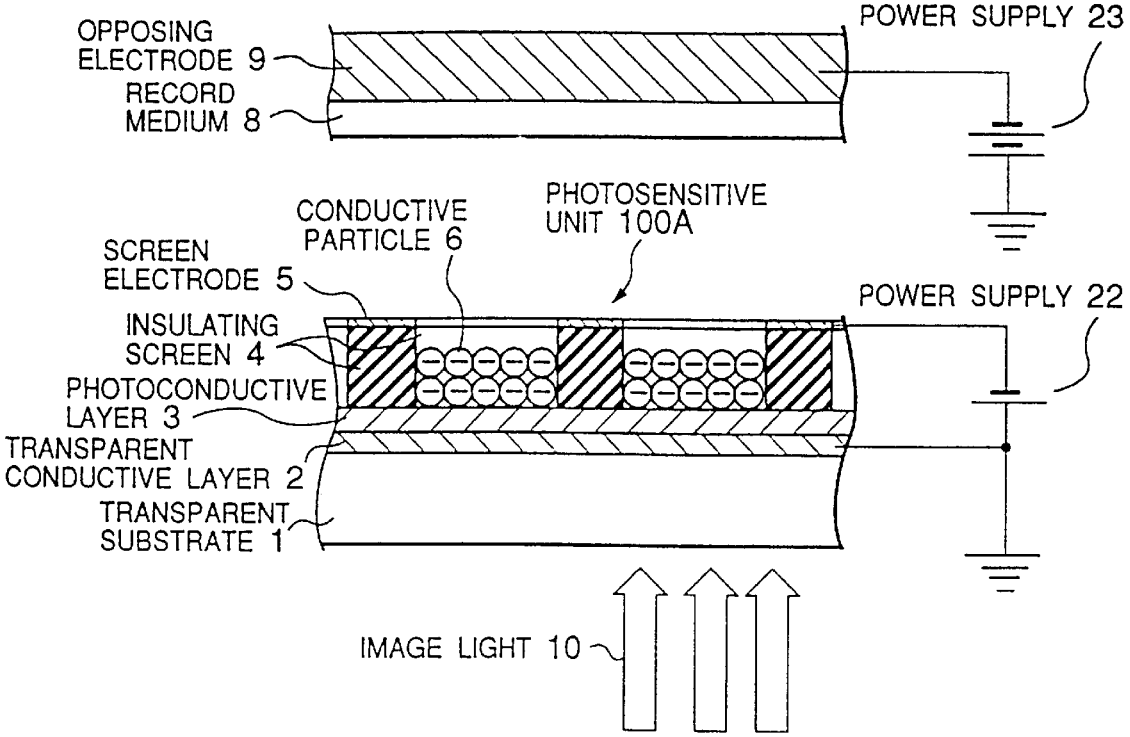
FIG. 1 is a section view for describing a principle of an image recording apparatus according to the present invention.

FIG. 1 is a section view for describing the principle of an image recording apparatus of the present invention. The image recording apparatus comprises at least a photosensitive unit 100A and an opposing electrode 9 which opposes to the photosensitive unit 100A with a record medium 8 between them.

The photosensitive unit 100A comprises a transparent substrate 1 such as a PET film, a transparent conductive layer 2 and a photoconductive layer 3 sequentially formed thereon, and a porous insulating screen 4 formed on the photoconductive layer 3. An electrode layer (hereinafter, referred to as a screen electrode 5) is formed only on the top surface of each insulating screen 4.

As the transparent conductive layer 2, a translucent film made of a metal such as aluminum formed by using, for example, a deposition-process or an ITO film is used. As the photoconductive layer 3, there are an inorganic photoconductive layer such as amorphous selenium or amorphous silicon or a photoconductive layer used for a known electrophotographic process such as an organic photoconductive layer. As the insulating screen 4, there is a screen made of an insulating polymeric film such as polyimide, PET, or PC having a plurality of minute holes. The insulating screen 4 requires a thickness at least twice as long as a diameter of a conductive particle 6 which is a conductive color particle used for recording. It is because the conductive particles 6 in a plurality of layers to be put into the minute holes in the porous insulating screen are selectively polarized to upper and lower layers by an exposure in a subsequent exposing process and conductive particles for recording are selected by means of induction charging for the conductive particles in the upper layer. If the thickness of the insulating screen 4 is shorter than twice as long as the diameter of the conductive particle 6, the conductive particles 6 to be put into the minute holes in the insulating screen 4 has only a single layer and hence the induction charging will not be favorably performed in this condition.

Figure 2:
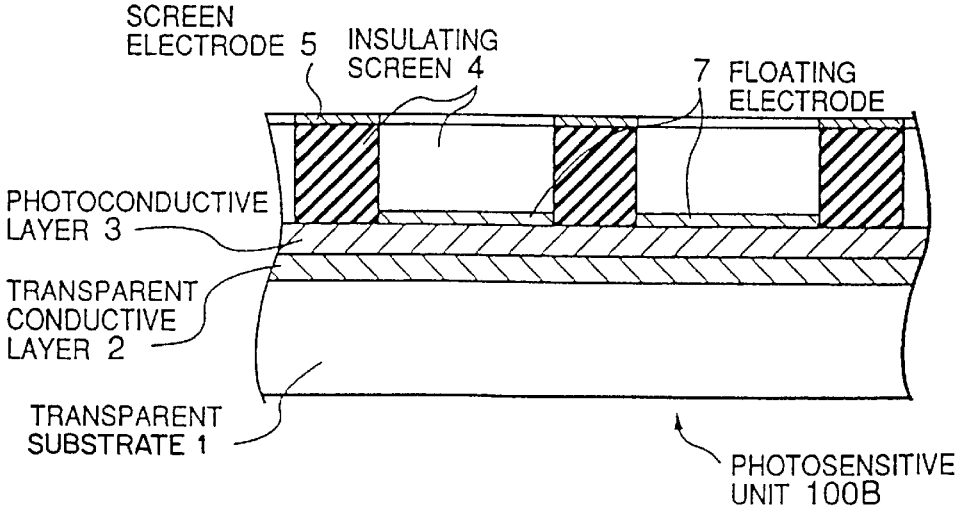
FIG. 2 is a section view illustrating an example different from one in FIG. 1 of a photosensitive unit used for an image recording apparatus according to the present invention.

FIG. 2 is a section view illustrating a general configuration illustrating another example of the photosensitive unit used for the image recording apparatus of the present invention. Composing elements in a photosensitive unit 100B shown in FIG. 2 that are identical to those in the photosensitive unit 100A in FIG. 1 are labeled with the same numerals. In the photosensitive unit 100B, a floating electrode 7 is put in each minute hole in the screen to reduce a contact resistance between the photoconductive layer 3 and conductive particles. Other constructions are the same as for the first embodiment.

Figure 3:
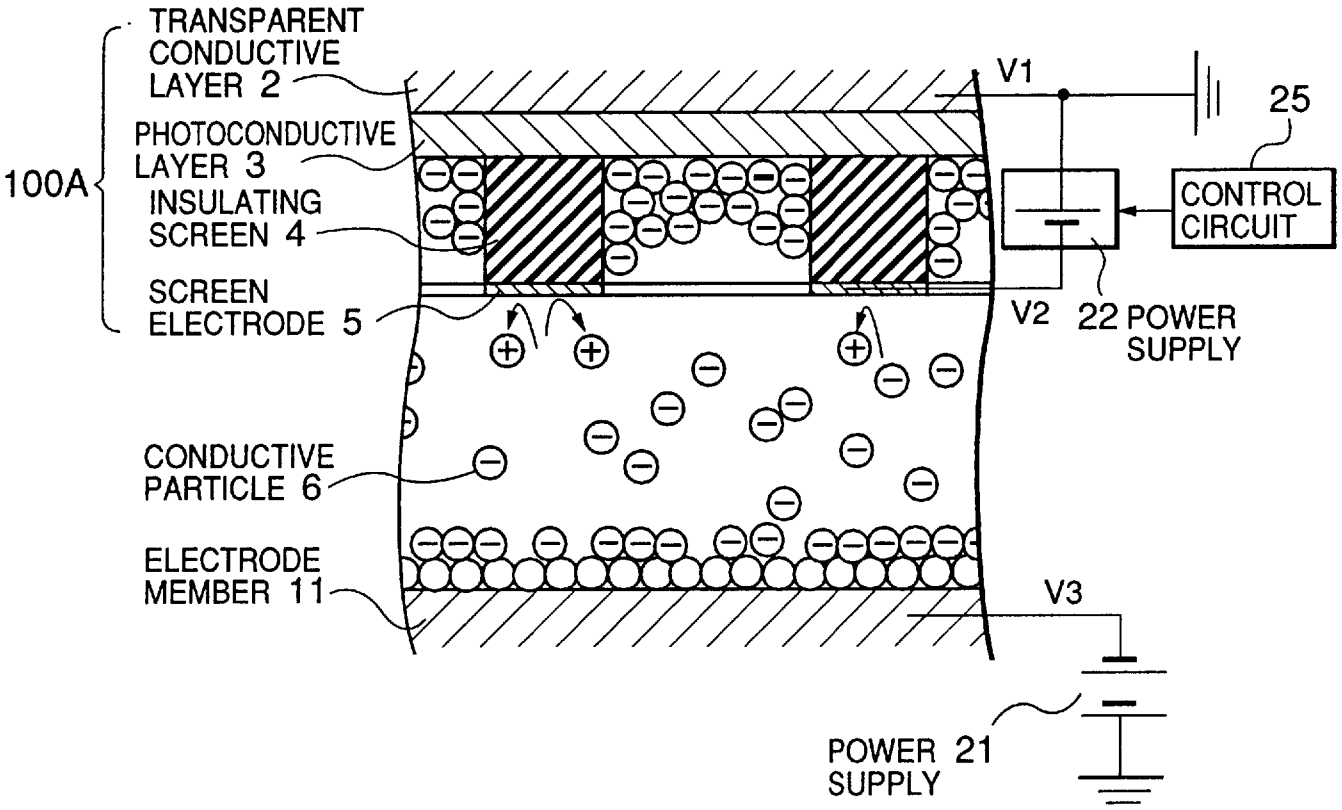
FIG. 3 is a section view illustrating a filling process of conductive particles into minute holes in the insulating screen.

Now, FIG. 3 is used to describe a process of filling the minute holes in the insulating screen with particles in the photosensitive unit 100A. The particle filling process is the same as for the photosensitive unit 100B.

First, a thin layer of the conductive particles 6 is formed on an electrode member 11 by using a known toner layer thickness regulating blade. The electrode member 11 is arranged so as to oppose to the photosensitive unit 100A with a gap between. DC voltages from a power supply 22 and a power supply 21 are applied to a screen electrode 5 and the electrode member 11, respectively. A first voltage V1 is applied to a transparent conductive layer 2 and a third voltage V3 is applied from the power supply 21 to the electrode member 11 so that the transparent conductive layer 2 of the photosensitive unit 100A becomes positive and the electrode member negative, and a second voltage V2 is applied from the second power supply 22 to the screen electrode 5 so that the transparent conductive layer 2 becomes positive and the screen electrode 5 on each surface of the screen 4 negative. At this point, the first to the third voltages are all DC voltages having a relationship represented by V1>V2>V3. One of the first voltage V1, second voltage V2 and third voltage V3 may be 0 (V).

The power supply 22 constructs a potential applying device for applying an electric potential (voltage V2) to the screen electrode 5 so that the conductive particles 6 supplied from the electrode member 11 return to the electrode member 11. Moreover, the power supply 22 is an electric field applying device for applying an electric field between the transparent conductive layer 2 and the screen electrode 5.

For example, assuming that the transparent conductive layer 2 is a ground (V1=0), the third voltage V3 applied to the electrode member 11 is −1000 V, the second voltage V2 applied to the screen electrode 5 is −70 V, and a thickness of the photoconductive layer 3 is 5 $\mu$m, the conductive particles 6 on the electrode member 11 are subjected to induction charging to negative first due to an electric field, and then jump toward the photoconductive layer 3. A gap between them can be 1 mm or so. Although some conductive particles 6 which have jumped impinge upon the surface of the screen electrodes 5, they are immediately charged to opposite polarity to return to the side of the electrode member 11. Accordingly, the conductive particles 6 charged to negative enter only into the minute holes in the screen 4. Since a potential of the conductive particles 6 after filling becomes almost equal to a potential of the screen electrodes 5, it is possible to generate an electric field of $10^5$ V/cm or greater (concretely, 70/5 (V/$\mu$m)=$70\times10^4/5$ (V/cm)) which is sufficient to cause a photoconductive phenomenon in the photoconductive layer 3 which is in contact with the conductive particles 6.

A control circuit 25 controls a value of an output voltage of the power supply 22 applied to the screen electrodes 5. This allows a filling amount to be controllable and prevents the charged conductive particles 6 from being put into contact with the screen electrodes 5, so that a clean image without fogging is obtained. The conductive particles 6 become hard to attach to the electrodes 5 on the surface of the screen by lowering conductivity of the electrode member 11 than conductivity of the screen electrodes 5 and therefore this configuration is preferable.

It is not always required that a thin layer of the conductive particles 6 is formed on the electrode member 11, but it is also possible to fill the minute holes in the screen 4 with the conductive particles 6 by allowing them to jump toward the screen 4 directly from a tank which has an electrode layer and contains the conductive particles 6.

As described in the above, there have been confirmed two effects; one is a remarkable effect that the conductive particles can be entered only into the minute holes in the screen without particles attached to the surface of the screen which may cause fogging, and the other is that a thickness of a particle layer in the screen can be arbitrarily controlled by a voltage applied to the screen electrodes 5, by providing the screen electrodes 5.

As shown in FIG. 1, the minute holes in the insulating screen are filled with the previously-charged conductive particles 6 in the above method. In the above example, the conductive particles 6 are negative-charged by the power supply 21. Although preferably a size or a space of each minute hole should be as small as possible since it is related to a resolution of an image, particles must be held to some extent to ensure an image density and therefore it is preferable that a side of a square minute hole or a diameter of a circular minute hole ranges approx. from 20 to 100 $\mu$m.

Figure 4:
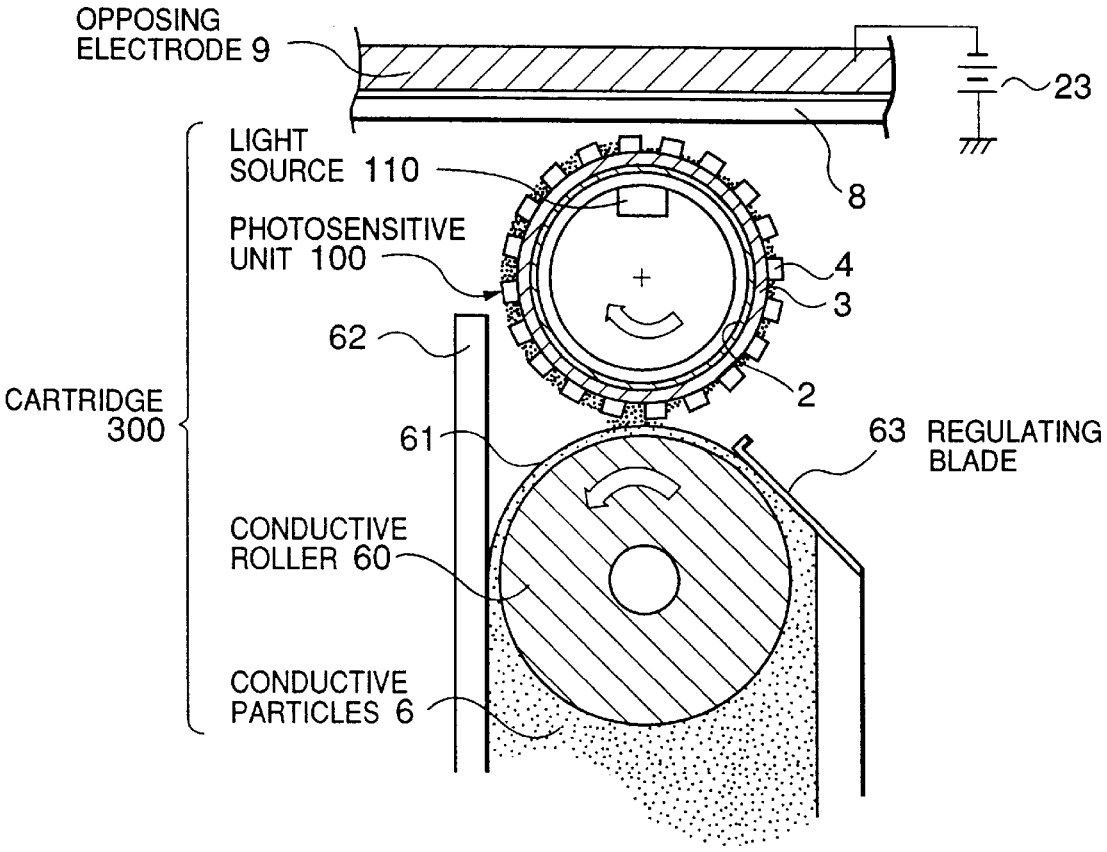
FIG. 4 is a section view illustrating a first embodiment of an image recording apparatus of the present invention.

FIG. 4 is a section view illustrating the first embodiment of the image recording apparatus of the present invention, particularly a diagram illustrating a configuration of a portion for forming a transferred image. Although various shapes such as a plate, an endless belt, or a cylinder can be used for the photosensitive unit 100, a cylindrical photosensitive unit is used here.

A cartridge 300 for an image formation comprises a cylindrical photosensitive unit 100 having the same structure as for the photosensitive unit 100A in FIGS. 1 and 3, a roller 60 which serves as the electrode member 11 in FIG. 3 and where a thin layer 61 of the conductive particles 6 is formed on its surface, a regulating blade 63, a light source 110, and a conductive particle container 62.

The cylindrical photosensitive unit 100 and the roller 60 rotate in each direction indicated by respective arrows, and the aforesaid first to the third voltages V1, V2, and V3 are applied so that electric fields are generated between the transparent conductive layer 2 composing the photosensitive unit 100 and the roller 60 and between the transparent conductive layer 2 and the screen electrodes 5 (FIG. 3), respectively.

Although the photosensitive unit 100 rotates in the direction indicated by the arrow in FIG. 4, the rotation direction can be an opposite direction. The light source 110 is contained in the photosensitive unit 100 and it is fixed without rotating together with the photosensitive unit 100. Additionally the light source 110 is opposite to the opposing electrode 9.

In a portion having a gap of approx. 1 mm or smaller between the photosensitive unit 100 and the roller 60, the conductive particles 6 on the roller 60 are subjected to induction charging and then jump toward the photosensitive unit 100 based on the principle shown in FIG. 3 so as to be entered only into the minute holes in the screen 4. Then, with a rotation of the photosensitive unit 100, the aforesaid particle filling portions oppose to a record medium 8 such as paper with a gap between. An opposing electrode 9 is arranged at the back of the record medium 8. Between the opposing electrode 9 and the transparent conductive layer 2 of the photosensitive unit 100, a DC electric field for transferring is formed by the third power supply 23. This DC electric field is preferably an electric field whose electrostatic field allows charged conductive particles 6 to jump toward the record medium 8 and does not generate any disturbance of an image caused by a repulsion between the conductive particles 6.

In transferring an image to the record medium, a portion up to the photoconductive layer 3 is irradiated with an image light 10 (See FIG. 1) such as a semiconductor laser light or an LED light corresponding to an image signal from the side of the transparent substrate 1 by using a light source 110, and then the conductive particles 6 are charged to a polarity opposite to one at the filling and attached to the record medium 8 for transferring. Accordingly, an exposure and a transfer are performed at a time.

Next, a description will be given in detail of a record principle used for the portion between the record medium 8 and the photosensitive unit 100 opposing each other by referring to FIGS. 5A to 5C.

Figure 5A:
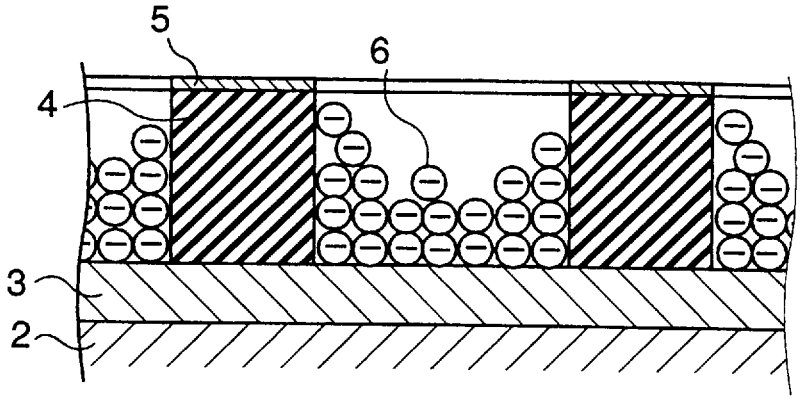
FIGS. 5A, 5B, and 5C are section views for describing exposing and transferring processes of the image recording apparatus in FIG. 4.

FIG. 5A illustrates a state that the conductive particles 6 are previously negative-charged being put in the minute holes in the insulating screen 4 in a plurality of layers, with the conductive particles having almost the same potential as for the screen electrodes 5. Therefore, it is possible to form an electric field which is high enough to generate a photoconductive phenomenon in the photoconductive layer 3 by selecting a potential difference between the transparent conductive layer 2 and the screen electrodes 5 and a thickness of the photoconductive layer 3.

Figure 5B:
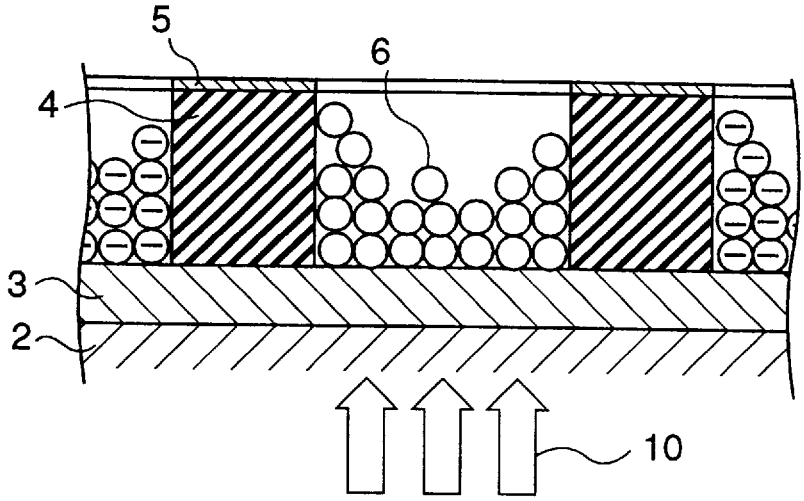

As shown in FIG. 5B, if the image light 10 corresponding to an image signal is put from the light source 110 (FIG. 4) in the side of the transparent conductive layer 2, a resistance value of the photoconductive layer 3 is lowered so that the charges of the charged conductive particles 6 becomes zero. After that, the conductive particles 6 are polarized to negative for the side of the photoconductive layer 3 and positive for the opposite side by the first and second voltages V1 and V2 applied to the transparent conductive layer 2 and the screen electrodes 5 or the electric field between the transparent conductive layer 2 and the opposing electrode 9, and the conductive particles 6 in the positive polarity have positive charges.

Figure 5C:
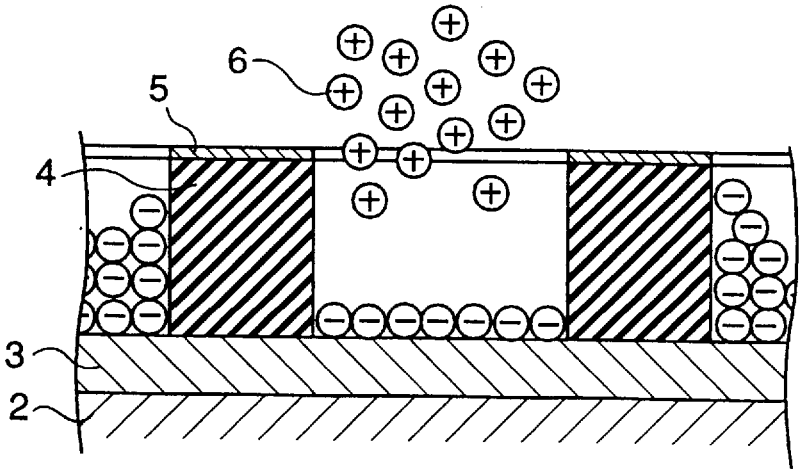

As shown in FIG. 5C, the positive-charged conductive particles 6 jump toward the opposing electrode 9 due to the electric field between the transparent conductive layer 2 and the opposing electrode 9 and then attach to the record medium 8. After that, the particles are fixed to paper in a known fixing process and the image forming process is then complete.

Figure 6:
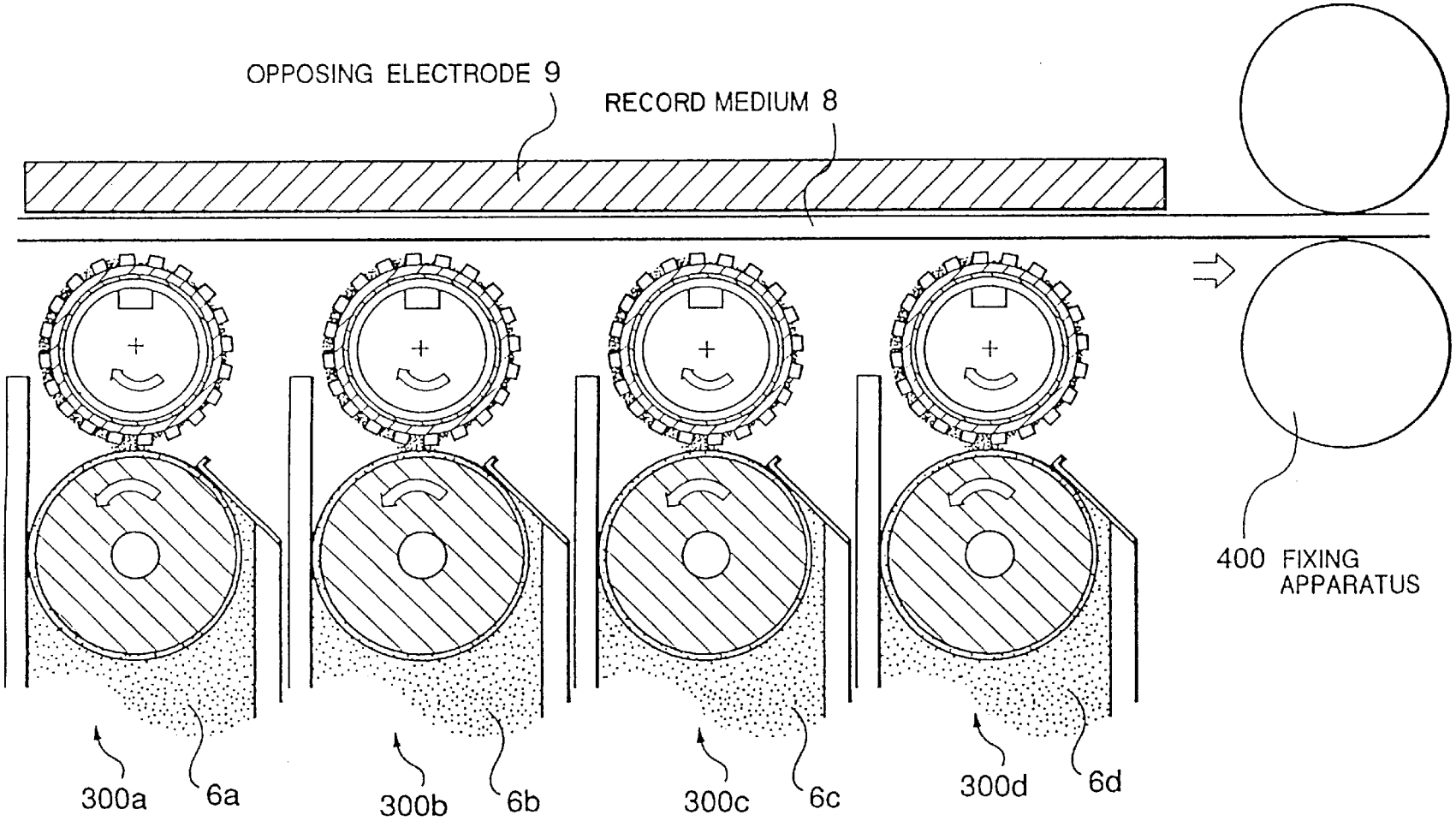
FIG. 6 is a section view illustrating a second embodiment of an image recording apparatus of the present invention.

FIG. 6 is a general diagram illustrating a second embodiment of the present invention for full-color recording with repeating aforesaid image forming process four times. It includes four cartridges 300 (300*a*, 300*b*, 300*c*, and 300*d*) composed as described in the above and a fixing apparatus 400.

The cartridges 300*a*, 300*b*, 300*c*, and 300*d* contain conductive particles of different colors 6*a*, 6*b*, 6*c*, and 6*d*. As the record medium 8 is delivered, the conductive particles having different colors attach to it sequentially so as to form a color image and then the attached conductive particles are fixed to the record medium 8 passing through the fixing apparatus 400. In other words, while the record medium 8 is delivered in a single direction, conductive particles of a plurality of colors attach to it so as to achieve a color image.

Figure 7:
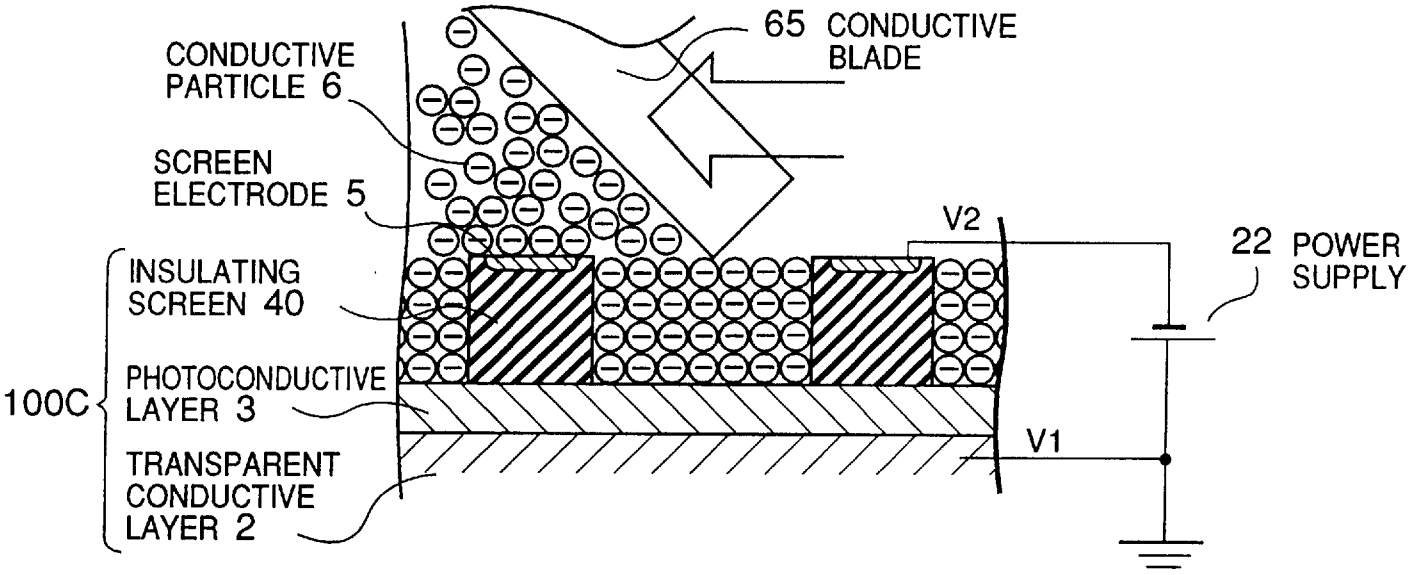
FIG. 7 is a section view for describing another example of filling the holes with conductive particles.

FIG. 7 is a general diagram for describing another method of filling with conductive particles. A second voltage V2 is applied to screen electrodes 5 by a power supply 22 so that a transparent conductive layer 2 of a photosensitive unit 100C is positive and the screen electrodes 5 on the surface of a screen 40 is negative. Minute holes in the insulating screen 40 are filled with negative-charged conductive particles 6 with sliding a conductive blade 65 on the screen 40, the conductive blade having the same potential as for the screen electrodes 5 and with at least a conductive surface, so as to uniform the thickness of the conductive particles 6. The insulating screen 40 insulates edges of the screen electrodes 5. As a result, the screen electrodes 5 are completely insulated from the conductive particles 6, so that a fogless image can be obtained. This embodiment can be used instead of the filling principle described by using FIG. 3.

Figure 8:
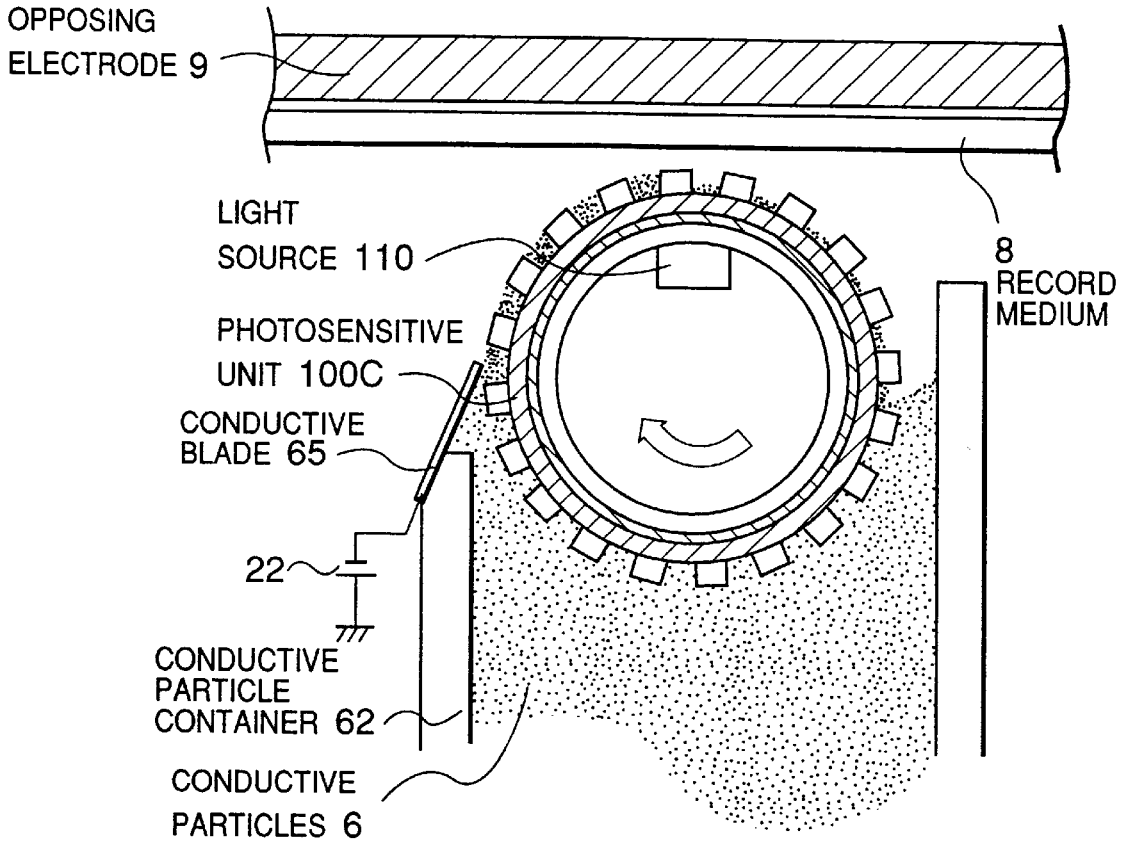
FIG. 8 is a section view illustrating a third embodiment of an image recording apparatus of the present invention.
Figure 9:
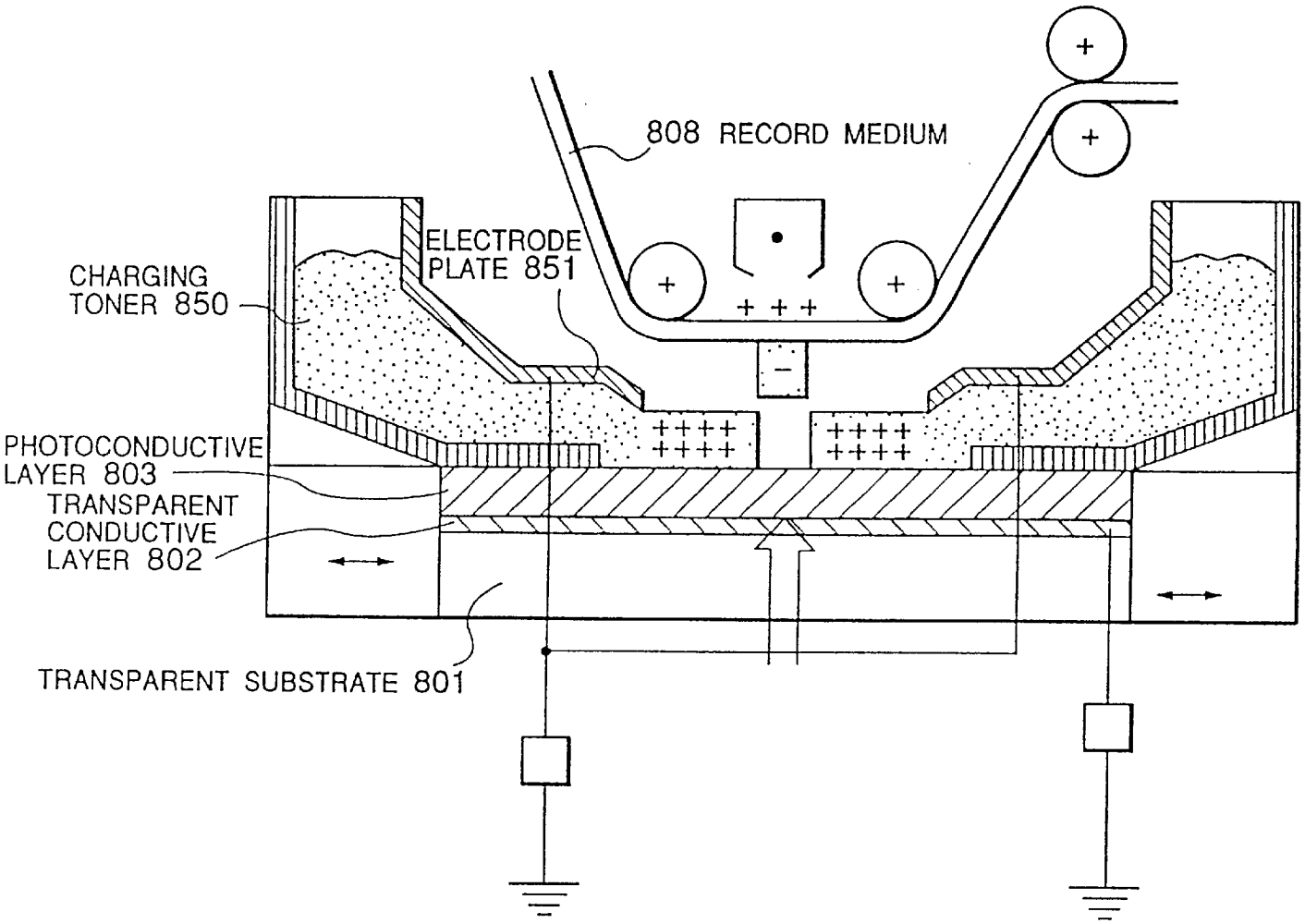
FIG. 9 PRIOR ART
FIG. 9 is a section view illustrating a conventional image recording apparatus.

FIG. 8 is a section view illustrating a third embodiment of the present invention to which the principle shown in FIG. 7 is applied. In this drawing, conductive particles 6 are stored in a container 62. A photosensitive unit 100C is arranged in the side of an opening of the container 62 with about half of the body buried in the conductive particles. A conductive blade 65 is fixed to an end of the opening of the container 62 with its tip brought into contact with a top surface of an insulating screen 40 of the photosensitive unit 100C by a given pressure as shown in FIG. 7. As a result, a thickness of the conductive particles 6 is limited as shown in FIG. 7. In addition, the conductive blade 65 is kept to the same potential as for screen electrodes 5 by a power supply 22. Accordingly, minute holes in the insulating screen 40 are filled with negative-charged conductive particles.

In this embodiment, the power supply 21 as shown in FIG. 3 and the conductive roller 60 as shown in FIG. 4 are not required and therefore the number of parts and a size of the circuit can be reduced.

Although, in the above-described embodiments, an example is described of filling the minute holes in the screen 4 or 40 with negative-charged particles, it is also possible to record an image by filling the minute holes in the screen with positive-charged particles. In this case, a polarity of the line voltage should be opposite and further an electron-moving photoreceptor be used for a photosensitive layer. In addition, the first to the third voltages V1 to V3 must satisfy a condition, V1<V2<V3, with the voltage V3 assumed to be a voltage necessary to positive-charge the particles.

Further, although conductive particles are used in the embodiments, it is apparent that conductive ink can also be used.

Still further, it is also possible to provide a means for cleaning remaining conductive particles in the minute holes in the screen of the photosensitive unit after recording.

The present invention is constituted as described in the above, there are the following effects.

Since only the minute holes in the porous screen can be filled with conductive particles being kept to be charged, particles do not attach to the surface of the screen other than the minute holes unlike the conventional apparatuses, and therefore the present invention has an effect of preventing an occurrence of fogging.

Further, since it is unnecessary to use a filling process which may damage the photosensitive unit, for example, by using a level plate and the minute holes can be filled by means of induction charging and a jumping phenomenon, the present invention has an effect of extending a life of the photosensitive unit.

Still further, since a potential of the particles in the minute holes in the porous screen is almost equal to a potential of the screen electrode layer, an electric field of $10^5$ V/cm or greater can be generated in the photoconductive layer and also electric fields in the minute holes are put into ideal conditions for jumping so as to allow the particles to jump efficiently, and therefore the present invention has an effect of obtaining high image density stably.

What is claimed is:

1. An image recording apparatus for recording an image by attaching conductive color particles to a record medium, comprising:

a rotating photosensitive unit including in a following sequence: a transparent conductive layer, a photoconductive layer, a porous insulating screen and an electrode layer formed on a top surface of said porous insulating screen;

particle supplying means for supplying conductive color particles charged to a given polarity to a plurality of minute holes formed in said porous insulating screen;

potential applying means for applying a predetermined electric potential to said electrode layer on the top surface of said porous insulating screen so that said electrode layer returns said conductive color particles supplied from said particle supplying means;

electric field applying means for applying an electric field to a portion between said transparent conductive layer and said electrode layer to cause a photoconductive phenomenon;

an exposing device for performing an exposing process on an exposing position, by irradiating said photoconductive layer of said photosensitive unit with a light selectively so as to generate the photoconductive phenomenon, said exposing process being performed after said particles supplying means supplies said charged conductive color particles to said minute holes; and a transferring means for transferring said conductive color particles in said minute holes at the exposing position to the recording medium by means of an electric field, the transferring means arranged opposite to said photosensitive unit.

2. An image recording apparatus according to claim 1 wherein said electric field applying means applies a voltage between said transparent conductive layer and said electrode layer.

3. An image recording apparatus according to claim 2, wherein:

said particle supplying means includes an electrode member holding said conductive color particles on a surface thereof, and means for applying a voltage to said electrode member so that an electric field is generated between said electrode member and said transparent conductive layer, opposing to said photosensitive unit with a gap between; and said conductive color particles charged according to said voltage are moved from said electrode member to said plurality of minute holes so as to be supplied to said minute holes.

4. An image recording apparatus according to claim 3 wherein, assuming that V1 is a first voltage applied to said transparent conductive layer, V2 is a second voltage applied to said electrode layer on the top surface of said insulating screen, and V3 is a third voltage applied to said electrode member of said particle supplying means, V1>V2>V3 is satisfied for a negative charging polarity of said conductive color particles from said particle supplying means, and V1<V2<V3 is satisfied for a positive charging polarity thereof.

5. An image recording apparatus according to claim 4 wherein said electrode member is a conductive roller which holds said conductive color particles on a surface thereof.

6. An image recording apparatus according to claim 4 wherein said particle supplying means further comprises a supplier of said conductive color particles to supply said conductive color particles to the surface of said electrode member.

7. An image recording apparatus according to claim 4 wherein one of said first voltage V1, second voltage V2 and third voltage V3 is 0 (V).

8. An image recording apparatus according to claim 3 wherein said electrode member of said particle supplying means has lower conductivity than that of said electrode layer on the top surface of said insulating screen.

9. An image recording apparatus according to claim 1 wherein said electric field applying means includes voltage applying means for applying a voltage between said transparent conductive layer and said electrode layer, and adjusting means for adjusting said voltage to control an amount of said charged conductive color particles put in said minute holes.

10. An image recording apparatus according to claim 1 wherein said particle supplying means includes a supplying means for supplying said conductive color particles to said insulating screen and a conductive blade for regulating said conductive color particles supplied from said supplying means, the conductive blade having at least a surface which is conductive and a potential equal to said electrode layer on the top surface of said insulating screen and being in contact with the top surface of said insulating screen.

11. An image recording apparatus according to claim 1 wherein said photosensitive unit, said particle supplying means, said exposing means, and said transferring means comprise a plurality of units for recording individually by using conductive color particles of a plurality of colors.

12. An image recording apparatus according to claim 1 wherein said exposing means is arranged opposite to said transferring means and irradiates a side of said transparent conductive layer of said photosensitive unit with a light.

13. An image recording apparatus according to claim 1 wherein a floating electrode is formed in said minute holes in said insulating screen.

14. An image recording apparatus for recording an image by attaching conductive color particles to a record medium, comprising:

a rotating photosensitive unit including in a following sequence: a transparent conductive layer, a photoconductive layer, a porous insulating screen and an electrode layer formed on a top surface of said porous insulating screen:

an electrode member for holding said conductive color particles on its surface, opposite to said photosensitive unit with a gap between;

means for applying a first voltage V1 to said transparent conductive layer;

means for applying a second voltage V2 to the electrode layer on the top surface of said insulating screen when said first voltage is applied;

means for applying a third voltage V3 to said electrode member;

exposing means for performing an exposure by putting a light on said photoconductive layer of said photosensitive unit selectively according to an image signal so as to cause a photoconductive phenomenon after supplying said conductive color particles to the minute holes in said insulating screen by means of said first to third voltages; and transferring means for transferring the conductive color particles in said minute holes at an exposed position to the record medium by means of an electric field.

15. An image recording apparatus according to claim 14 wherein there is a relationship V1>V2>V3 among said first to third voltages V1 to V3 if the charging polarity of said conductive color particles supplied to said minute holes in said insulating screen is negative and a relationship V1<V2<V3 among them if said charging polarity is positive.

16. An image recording apparatus according to claim 15 wherein one of said first voltage V1, second voltage V2 and third voltage V3 is 0 (V).

* * * * *